US012604972B2

(12) United States Patent
Laverock

(10) Patent No.: US 12,604,972 B2
(45) Date of Patent: Apr. 21, 2026

(54) HAIR BRUSH COMPRISING REMOVABLE AND REPLACEABLE BRISTLE PAD

(71) Applicant: John Laverock, Richmond (CA)

(72) Inventor: John Laverock, Richmond (CA)

( * ) Notice: Subject to any disclaimer, the term of this patent is extended or adjusted under 35 U.S.C. 154(b) by 466 days.

(21) Appl. No.: 18/100,553

(22) Filed: Jan. 23, 2023

(65) Prior Publication Data

US 2024/0245207 A1 Jul. 25, 2024

(51) Int. Cl.
*A46B 7/04* (2006.01)

(52) U.S. Cl.
CPC ..... *A46B 7/042* (2013.01); *A46B 2200/104* (2013.01)

(58) Field of Classification Search
CPC ..... A46B 5/0095; A46B 7/04; A46B 7/042; A46B 9/023; A46B 15/0055; A46B 15/0085; A46B 2200/104
USPC ..... 15/186–188
See application file for complete search history.

(56) References Cited

U.S. PATENT DOCUMENTS 1,166,296 A * 12/1915 Wolfe et al. ..... A46B 5/0033 15/185
3,634,178 A * 1/1972 Goodman ..... A46B 15/00 63/26
11,395,539 B2 * 7/2022 Stanton ..... A46B 5/021
2015/0189979 A1 * 7/2015 Stanton ..... A46B 5/021 15/106
2025/0151888 A1 * 5/2025 Chu ..... A46B 9/023

* cited by examiner

*Primary Examiner* — Brian D Keller
*Assistant Examiner* — Aaron R McConnell

(57) ABSTRACT

The present invention is a hair brush that features a unique and innovative design that addresses a common problem faced by many hair brush users—the difficulty of replacing the bristle pad within the brush head quickly and easily. The invention provides a solution by incorporating various features that make the pad removable and replaceable. The flexible pad is provided with finger indentations on either side, which makes it easy for the user to grip and securely attach it to the brush head. The brush head is also designed with finger indentations, which are specifically aligned with the pad indentations to make it even more convenient for the user to remove and replace the pad. This feature makes it effortless and convenient to remove and replace the pad, and provides an easy and comfortable way to handle the pad. This feature is particularly useful for people with weak grip or limited dexterity, making hair care accessible to a wider range of people. This invention is designed to make hair care more efficient, user-friendly and cost-effective. The handle badge is to identify the users own brush to allow the user to eliminate any and all hygienic concerns and is useful in any and all hair brush sizes, shapes and types.

8 Claims, 6 Drawing Sheets

HAIR BRUSH COMPRISING REMOVABLE AND REPLACEABLE BRISTLE PAD

FIELD OF THE INVENTION

This invention relates generally to the field of hair accessories, hair brushes, and in particular, to a hair brush with a removable, customizable and replaceable brush pad.

CROSS-REFERENCE TO RELATED APPLICATION

This application claims the benefit of U.S. Provisional Patent Application No. 63/340,553, filed May 11, 2022, which is incorporated by reference herein in its entirety.

BACKGROUND OF THE INVENTION

Hair brushes have been in use for many years as a tool for maintaining, detangling and grooming hair. They are used for detangling, styling, and simply combing a user's hair. The hair brush industry offers a wide variety of styles, shapes, configurations, and construction, catering to different hair types, styles and personal preferences.

Most hair brushes typically have a brush head with a plurality of bristles protruding from a brushing or working surface. These bristles are typically made from a variety of materials such as natural hair and fibers, synthetic fibers, or a combination of both. They are usually spaced apart on a pad, which is affixed to the base of the brush head. The brush head is generally connected to a handle, which is designed for easy gripping and maneuvering of the brush.

A common issue with traditional hair brushes is that as the bristles wear out with everyday usage, the entire brush is often discarded. This is highly wasteful as the brush handle and other parts of the brush are still in good condition. This not only adds to the consumer's cost but also contributes to environmental pollution and excessive costs related to purchasing an entire brush again.

This invention aims to address this issue by providing a hair brush design that allows for easy replacement of worn out bristles and bristle pad, without the need to discard the entire brush. This not only reduces waste, but also saves the consumer money in the long run, as they can simply replace the bristles/bristle pad instead of buying a new brush. This invention also aims to provide a more sustainable option for hair brush consumers, as it reduces the environmental impact of discarded brushes. Overall, this invention provides an innovative solution to a common problem in the hair brush industry, making it a more sustainable, cost-effective and eco-friendly choice for consumers.

The present invention aims to obviate or mitigate various disadvantages and wastefulness of known brush configurations, by introducing a new design that improves overall performance and functionality, while reducing any wasteful practices associated with traditional designs. As you read through this specification from beginning to end, the benefits of this new design will become more obvious.

SUMMARY OF THE INVENTION

The goal of this invention is to create a versatile hair brush that can adapt to different hair types and styles, by providing a flexible pad of bristles that can be easily removed and replaced. The brush comprises an array of bristles that are attached to or mounted on the flexible pad. The pad is designed to be easily disengaged from the brush so that it can be replaced by the user. This feature provides a convenient and cost-effective solution for maintaining the brush and ensuring that it is always in optimal condition.

The ability to replace the pad allows the user to customize the brush according to their specific hair needs, whether it's for detangling, styling, or smoothing. The removable pad also makes the brush more hygienic, as it can be replaced or cleaned more frequently. This invention is designed to make hair care more efficient, hygienic and user-friendly.

The present invention aims to create a replaceable and flexible pad for use with a hair brush, which is designed to make hair styling more convenient and efficient. The pad also has finger-depressions or indentations on both sides, which are specifically designed to indicate finger placement and to help users remove and insert the pad into the recessed bed of the brush head. These finger-depressions make it easier to handle the pad and securely attach it to the brush head. The finger-depressions on the pad also assist in ensuring a secure fit of the pad into the recessed bed of the brush head, preventing any doubt on how to insert the brush pad and eliminates any slippage or movement during use, which can make the brushing experience more comfortable, convenient and efficient.

One of the main advantages of this invention is that it allows for the pad to be replaced easily and quickly, which makes the brush more hygienic and cost-effective. The pad can be replaced when it becomes worn out or damaged, ensuring that the brush is always in optimal condition. The replaceable pad also allows for users to customize the brush pad according to their hair needs, simply by changing the required bristle size for various hair types, whether it's for detangling, styling, or smoothing. The flexible pad also adapts/conforms to the shape of the scalp, making the brush more comfortable to use.

It is an object of the present invention to provide a brush comprising a handle and head. The said head of the brush includes a recessed bed that is specifically designed to securely hold a removable, flexible pad that is equipped with bristles.

The brush also features a set of finger depressions located on opposed sides of the head. These finger depressions are designed to match corresponding finger grip depressions on the bristle-holding pad, making it easy for users to insert and remove the pad from the recessed bed of the brush. The purpose of this design is to provide a brush that is easy to use and maintain, allowing users to easily change out the bristle-holding pad as needed.

The invention relates to a brush that includes a handle with a recessed badge holder located near the end of the handle. The badge holder is designed to hold a variety of interchangeable badges that match or identify with the shape of the brush holder. These badges can be easily inserted and replaced, allowing users to personalize and customize their brush to suit their individual preferences and needs. The brush handle with the recessed badge holder allows for an easy way to change the badge and customize the brush for different uses. This also allows for 2 consumers knowing each other or living in the same household having 2 similar colored brushes, being the same color, to have different badges to clearly identify which one is theirs allowing for more hygienic experience.

With these objects in mind, the present invention comprises a hair brush comprising a handle and conjoined head and a removable and replaceable, flexible pad, with an array of bristles disposed thereon, wherein the head comprises, on one side, a recessed bed, of a sufficient size and shape to accommodate the flexible pad, said head also providing on an outer rim/marking/recesses at each of its opposing sides, a head finger depression, wherein the flexible pad comprises a set of pad finger depressions, one of each opposed side of the pad, to assist in the removal and replacement of the pad within the recessed bed, said pad finger depressions aligning with the head finger depressions, when the pad is in alignment within the bed.

The ability to easily remove and replace pads in association with a brush head/handle is especially beneficial for detangling brushes. Firstly, the bristles of detangling brushes tend to wear out faster than the brush head/handle, which are typically made of durable materials such as hard plastic or wood. Having the ability to purchase new pads with new bristle arrays and simply re-insert them into an existing brush head would be highly desirable, as it would provide a cost-effective and hygienic solution for maintaining the brush and ensuring that it is always in optimal condition.

Secondly, having the ability to purchase new pads with different bristle arrays and customize them based on desired bristle types, arrangements, and color schemes would allow users to tailor the brush to their specific hair needs and preferences. This would make the brushing experience more efficient, comfortable and satisfying.

Thirdly, offering consumers the option to purchase brush (1-10), pad (2), bristle type (4-18) and badge (6-20) combinations that are interchangeable would allow them to create unique brushes based on their hair type and color preferences. This would enhance the overall user experience and make the brush more personal and appealing.

In summary, the innovative design of a hair brush with a removable and replaceable pad provides a multitude of benefits for the user. The ability to easily remove and replace the bristled pad in association with the brush head and handle offers a convenient and cost-effective solution for maintaining the brush and ensuring it remains in optimal condition. Additionally, the ability to customize the pad of different sizes and shapes with different bristle types, arrangements, and color schemes allows for a personalized brushing experience that caters to the user's specific hair needs and preferences. This not only enhances the overall brushing experience but also makes it more efficient and satisfying for the user.

These and other advantages will become apparent throughout this specification.

and

Figure 6:
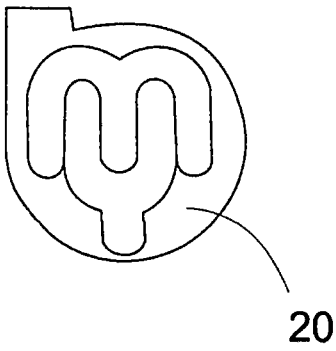

FIG. 6 is a front plan view of a badge.

The illustrations provided are intended to serve as examples of the current invention, and are not meant to be exhaustive or limiting in any way. Those with expertise in the field will understand that there are many other ways to implement the structures and methods described in this invention, without deviating from its core principles. In other words, the figures are provided as a visual aid to help explain the invention, but they should not be taken as the only way to execute it.

DETAILED DESCRIPTION OF THE PREFERRED EMBODIMENTS

A comprehensive and detailed explanation of one or more embodiments of the invention is provided below, along with accompanying figures that demonstrate the principles of the invention. The invention is explained in relation to these embodiments, but it is not limited to them. The invention includes various alternatives, modifications, and equivalents that can be applied to different situations and contexts. In order to provide a thorough understanding of the invention, numerous specific details are given in the following description.

These details are provided for the purpose of illustration and example, and they should not be interpreted as limiting the scope of the invention. The invention can be practiced without some or all of these specific details, depending on the specific application or context. Additionally, technical information that is already known in the relevant technical fields has been omitted to avoid obscuring the invention or adding unnecessary complexity to the description. The invention encompasses a wide range of possibilities and the detailed description provided below is intended to provide a clear and comprehensive understanding of the invention and its various embodiments.

I. Terms

The term "product" means any brush or component thereof, as described herein.

The term "method" means any process, method or the like, unless expressly specified otherwise.

Each process (whether called a method or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

The term "invention" and the like mean "the one or more inventions disclosed in this application", unless expressly specified otherwise.

The terms "an aspect", "an embodiment", "embodiment", "embodiments", "the embodiment", "the embodiments", "one or more embodiments", "some embodiments", "certain embodiments", "one embodiment", "another embodiment" and the like mean "one or more (but not all) embodiments of the disclosed invention(s)", unless expressly specified otherwise.

The term "variation" of an invention means an embodiment of the invention, unless expressly specified otherwise.

A reference to "another embodiment" or "another aspect" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "plurality" means "two or more", unless expressly specified otherwise.

The term "herein" means "in the present application, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase "at least one of a widget, a car and a wheel" means either (i) a widget, (ii) a car, (iii) a wheel, (iv) a widget and a car, (v) a widget and a wheel, (vi) a car and a wheel, or (vii) a widget, a car and a wheel. The phrase "at least one of", when such phrase modifies a plurality of things does not mean "one of each of" the plurality of things.

Numerical terms such as "one", "two", etc. when used as cardinal numbers to indicate quantity of something (e.g., one widget, two widgets), mean the quantity indicated by that numerical term, but do not mean at least the quantity indicated by that numerical term. For example, the phrase "one widget" does not mean "at least one widget", and therefore the phrase "one widget" does not cover, e.g., two widgets.

The phrase "based on" does not mean "based only on", unless expressly specified otherwise. In other words, the phrase "based on" describes both "based only on" and "based at least on". The phrase "based at least on" is equivalent to the phrase "based at least in part on".

The term "represent" and like terms are not exclusive, unless expressly specified otherwise. For example, the term "represents" do not mean "represents only", unless expressly specified otherwise. In other words, the phrase "the data represents a credit card number" describes both "the data represents only a credit card number" and "the data represents a credit card number and the data also represents something else".

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

The term "e.g." and like terms mean "for example", and thus does not limit the term or phrase it explains.

The term "respective" and like terms mean "taken individually". Thus if two or more things have "respective" characteristics, then each such thing has its own characteristic, and these characteristics can be different from each other but need not be. For example, the phrase "each of two machines has a respective function" means that the first such machine has a function and the second such machine has a function as well. The function of the first machine may or may not be the same as the function of the second machine.

The term "i.e." and like terms mean "that is", and thus limits the term or phrase it explains. For example, in the sentence "the computer sends data (i.e., instructions) over the Internet", the term "i.e." explains that "instructions" are the "data" that the computer sends over the Internet.

Any given numerical range shall include whole and fractions of numbers within the range. For example, the range "1 to 10" shall be interpreted to specifically include whole numbers between 1 and 10 (e.g., 1, 2, 3, 4, . . . 9) and non-whole numbers (e.g. 1.1, 1.2, . . . 1.9).

Where two or more terms or phrases are synonymous (e.g., because of an explicit statement that the terms or phrases are synonymous), instances of one such term/phrase does not mean instances of another such term/phrase must have a different meaning. For example, where a statement renders the meaning of "including" to be synonymous with "including but not limited to", the mere usage of the phrase "including but not limited to" does not mean that the term "including" means something other than "including but not limited to".

Neither the Title (set forth at the beginning of the first page of the present application) nor the Abstract (set forth at the end of the present application) is to be taken as limiting in any way as the scope of the disclosed invention(s). An Abstract has been included in this application merely because an Abstract of not more than 150 words is required under 37 C.F.R. .sctn. 1.72(b). The title of the present application and headings of sections provided in the present application are for convenience only, and are not to be taken as limiting the disclosure in any way.

The present application describes multiple embodiments of the invention, which are provided as examples of how the invention can be applied. These embodiments are not intended to limit the scope of the invention in any way, but rather to demonstrate its potential uses and applications. The invention can be applied in various ways, and it is possible to make structural and logical modifications to adapt it to different situations or to improve its performance.

One of ordinary skill in the art, meaning someone with knowledge and experience in the relevant field, will recognize that the disclosed invention(s) can be practiced with various modifications and alterations. These modifications and alterations may include changes to the structure of the invention, changes to the logic or the way it operates, and other adjustments to suit different needs or situations.

It is important to note that any feature described in relation to a specific embodiment or drawing is not limited to usage in that specific embodiment or drawing alone. These features can be used in other embodiments or drawings as well, unless they are specifically stated otherwise. This means that the invention can be adapted and applied in different ways depending on the specific needs and requirements of the user.

No embodiment of method steps or product elements described in the present application constitutes the invention claimed herein, or is essential to the invention claimed herein, or is coextensive with the invention claimed herein, except where it is either expressly stated to be so in this specification or expressly recited in a claim.

II Overview

The invention of this hair brush is designed to address a common problem, which is the difficulty of replacing the bristle pad within the brush head quickly and easily. The invention provides a solution by incorporating various features that make the pad removable and replaceable.

One of the key features of the invention is that the pad, which bears the bristles, is flexible or deformable. This allows the user to bend the outer edges of the pad downward and inward towards the inner surface of the pad, making it easier to insert the pad into the recessed bed in the brush head. Once the pad is in place, the outer edges are secured within the recessed bed by forced abutment against the walls of the bed, as the pad retracts back to its original shape. This ensures that the pad stays securely in place and can be easily removed and replaced by the user as needed.

The invention also includes a feature that makes it even easier for the user to remove and replace the pad. On either opposed side of the pad, there are finger indentations/grips that are designed for the user to grip and pinch the pad inwardly. These indentations make it easy for the user to handle the pad and securely attach it to the brush head. These indentations are preferably made with a striated or textured surface, or coated with a material that provides extra grip, making it easier for the user to hold and manipulate the pad. Additionally, there are no bristles on the area of the pad that encompasses the finger indentations, which makes it even more comfortable to grip and remove the pad.

Furthermore, the invention includes a unique feature that makes it even more convenient for the user to remove and replace the pad. The brush head is designed with finger indentations/depressions on either side (4-24), which are specifically designed to align with the finger indentations (2-22) on the pad. These brush head finger depressions are located on the upper surface of the outer rim (4-26) that surrounds the recessed bed (4-30) and make it even easier for the user to grip and securely attach the pad. This feature makes it effortless and convenient to remove and replace the pad, and provides an easy and comfortable way to handle the pad. The alignment of the respective indentation on the head and pad makes it even more user-friendly and efficient. This feature is particularly useful for people with weak grip or limited dexterity, making hair care accessible to a wider range of people.

With this orientation, removal and replacement of the pads is easy and simply involves a user placing his or her fingers in each of the aligned indentations and pinching the pad inwardly in order to release the pad from the gripped engagement within the walls of the recessed bed. Once the pad to be removed clears the walls of the recessed bed, grip on the pad finger indentations can be released. If a user simply wishes to replace a pad with differing types of bristles (ex: sizes of bristles, type of materials etc. . . . ) the removed pad (i.e. not in use) can be appropriately stored and then re-inserted as desired.

The aligned grips and indentations between pad and brush head are instrumental in easy removal and insertion of new pads.

Furthermore, with the ability to change pads comes a high degree of brush customization. This can extend to colours of pads to match or contrast with the handle/head colour. Branded badges can also be coloured selected and inserted in a badge slot on the handle. This allows the brush to be clearly identified by the use with their own unique badge color or design encouraging better hygienic responsibility.

III Details

The present invention provides a hair brush that is designed for ease of use and maintenance. The brush is composed of three main parts: a handle, a conjoined head and a removable and replaceable flexible pad. The head of the brush is designed with a recessed bed that is large enough to accommodate the flexible pad and the bed is located on one side of the head. The head also has finger depressions on the outer rim of the opposing sides. These finger depressions are used to assist in the removal and replacement of the flexible pad within the recessed bed. The flexible pad also has finger depressions on the opposing sides, which align with the head finger depressions when the pad is in place. It is worthy of note that the replacement of pads for the increase or decrease in bristle length/strength directly targets an individual's hair type, be it normal, fine or thick hair types.

The brush is designed with removable and replaceable flexible pad to be easy to maintain and can be disassembled for cleaning or replacement of the flexible pad.

FIGURES

Various aspects of the invention will now be described with specific reference to the figures mentioned in the brief description of drawings, where like numerals denote the same components across all figures.

Figure 1:
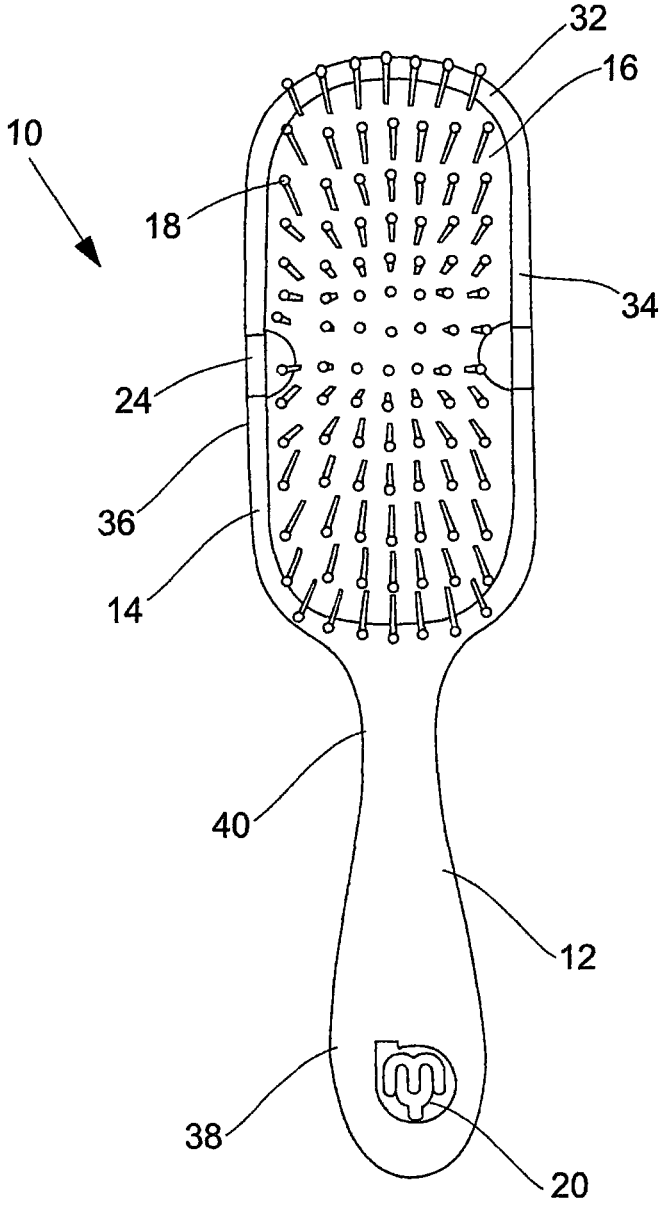
FIG. 1 is a top view of a brush in accordance with the present invention.

FIG. 1 is a front plan view of brush shown generally at 10 and comprising handle 12, head 14, pad 16, bristles 18 and badge 20. In this figure alignment of pad finger depressions 22 (FIG. 5) and head finger depressions 24 can clearly be seen. Head finger depressions 24 are disposed on outer rim 26 (best seen in FIG. 4). Brush head (1-14) comprises end 32, and two opposing sides 34 and 36. Brush handle 12 comprises bulbous end 38 and narrowing center neck 40, which adjoins (and is preferably integral with) head 14.

Figure 2:
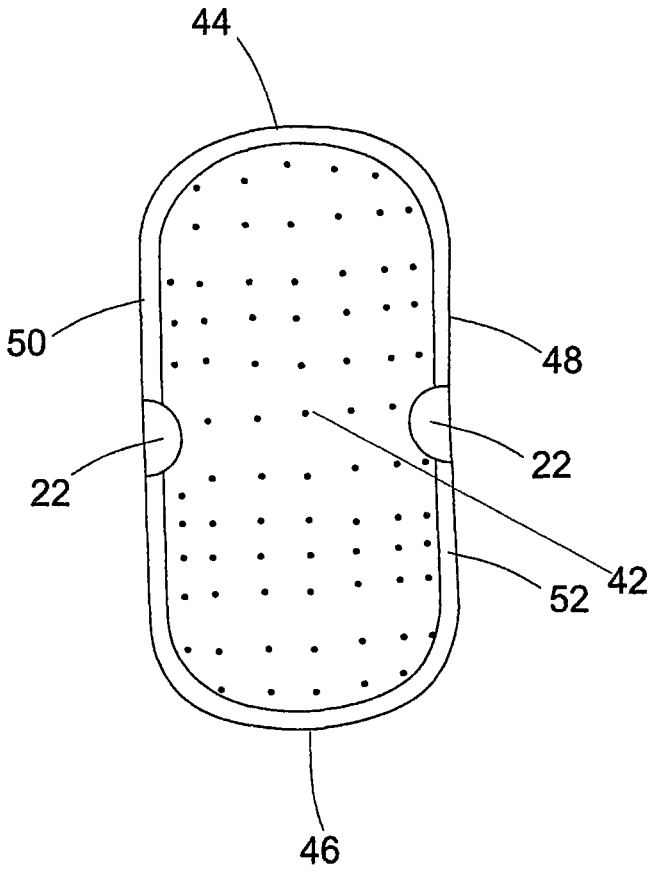
FIG. 2 is a top view of a flexible pad in accordance with the present invention.
Figure 4:
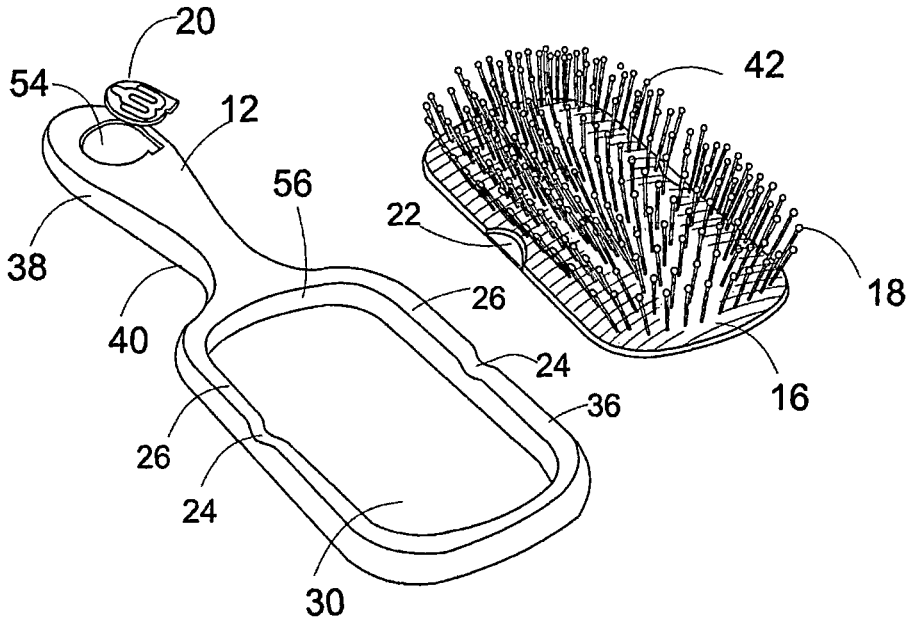
FIG. 4 is an exploded perspective view of a brush of the invention, showing the head and handle detached from a flexible, removable pad, with bristles arranged thereon.

FIG. 2 illustrates pad 16 (FIG. 1) in a position removed from recessed bed 30 (bed seen best, empty, in FIG. 4). Pad finger depressions 22 are clearly shown with inclined surface away from convex center 42 of pad. In this figure, pad finger depressions are shown as semi-circular shaped. Pad 16 comprises top end 44, bottom end 46, and opposing sides 48 and 50. Pad finger depressions 22 are in each of opposing sides 48 and 50, about equi-distant from top end 44 and bottom end 46. Pad 16 comprises bristles 18 affixed therein. Pad 16 comprises outer edge 52 running circumferentially around top end 44, side 48, bottom end 46 and side 50, said outer edge being free of bristles.

Figure 3:
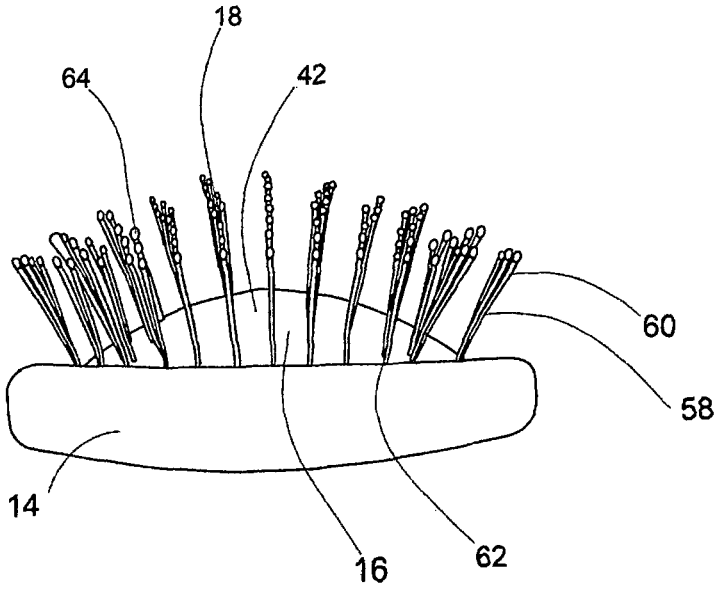
FIG. 3 is a front view of the brush of FIG. 1.

FIG. 3 best illustrates bristles 18 extending from pad 16, and convex center 42.

FIG. 4 shows an exploded perspective view of pad 16 comprising bristles 18 removed from recessed bed 30. The generally convex shape of pad 16 is best shown here. Pad finger depressions 22 are best shown here. Badge 20, removed from its snap-in mating holder 54 in handle 12 is best shown here. Inner walls 56 of recessed bed 30, against which outer edge of pad 16 abuts once in place in the recessed bed, is best shown here.

Figure 5:
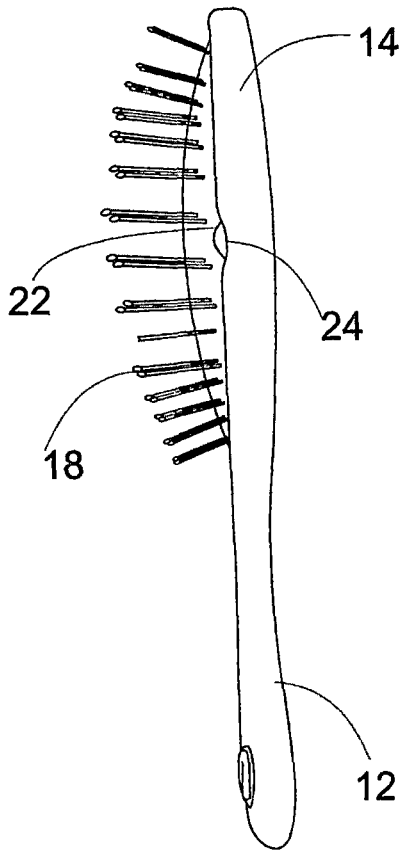
FIG. 5 is a side view of the brush of FIG. 1.

FIG. 5 shows a side view of brush 10 wherein pad 16 in situ, within recessed bed 30 and best showing the actual alignment of head finger depressions 24 and pad finger depressions 22. The "depression" of head finger depression actually makes visible pad finger depression 22.

FIG. 6 shows badge 20, in isolation. It is important to note that the badge is designed not only to be used on a hair brush with a removable pad. The inventor has intended for this feature to be used in any brush design, whether it features a removable pad or not. The badge is a unique aspect of the design and is worth mentioning as it serves a practical purpose. It helps the user to identify their brush and avoid confusion, for example, if the user has multiple blue brushes, it will be easy to differentiate between them if one has a yellow badge and the other has a white badge. This feature helps to maintain hygiene and avoid the sharing of personal items. Additionally, it can also serve as a way of personalizing the brush and making it easily identifiable.

In regards to bristle orientation on the pad, multiple columns can be aligned or offset as desired. The pad comprises preferably a plurality of perforations formed there through. Each of the plurality of bristles can be interspersed among the perforations.

Bristles may be natural or monofilament bristles. Each of the monofilament bristles can be a man-made molded or extruded synthetic structure. Each monofilament bristle can be formed of any suitable rigid of semi-rigid material, such as plastic, nylon, thermoplastic elastomer, metal or the like. In one example, the monofilament bristles can each be extruded and cut to length from a nylon material. As shown in the figures (best in FIG. 3), each monofilament bristle 18 has a stalk 58, a free end 60, and a secured end 62.

The secured ends 62 in this example are formed to create a hook thereon. The free ends 60 are formed with an optional ball 64 on the tip of the stalk 58. In one example, each monofilament bristle 18 can be heated and bent to form the hook and the free end 60 can be dipped in a secondary material, such as an epoxy paint, to form the ball 64 on the tip.

As will be evident to those having ordinary skill in the art, the configuration and construction of the monofilament bristles 18 can vary within the spirit and scope of the present invention. Each bristle can be individually molded. Each monofilament bristle 18 can be the same as the other monofilament bristles on the hair brush 10 or the hair brush can include two or more different types of monofilament bristles that are different in length, diameter, material, shape, and/or the like. The arrangement of the various bristles on the hair brush 10 can also vary within the spirit and scope of the present invention.

In these figures, by way of illustration, the head 14 is paddle-shaped and is somewhat rectangular, although other head shapes may certainly be used and/or included.

The pad (4-16) is formed of a strong yet flexible material such as thermoplastic rubber (TPR) and is generally planar. The pad supports the plurality of bristles 18 in a geometric grid of rows and columns. Said bristles 18 are arranged on the front surface of the pad 16. The plurality of bristles extend outward from and generally perpendicular to the front surface of the pad 16 in a direction opposite the back surface (not shown). The plurality of bristles 18 may be integrally formed or molded with the pad 16 from the same flexible material.

As will be apparent to those skilled in the art, the various embodiments described above can be combined to provide further embodiments. Aspects of the present systems, methods and components can be modified, if necessary, to employ systems, methods, components and concepts to provide yet further embodiments of the invention. For example, the various devices and methods described above may omit some parts or acts, include other parts or acts, and/or execute acts in a different order than set out in the illustrated embodiments.

Further, in the methods taught herein, the various acts may be performed in a different order than that illustrated and described. Additionally, the methods can omit some acts, and/or employ additional acts.

The present invention is not limited to the specific embodiments described in the specification and the claims, and various changes and modifications can be made to the articles in light of the above description. In general, the terms used in the following claims should not be interpreted to limit the invention to the specific embodiments disclosed, but should be interpreted to encompass all possible embodiments and the full scope of equivalents to which such claims are entitled. For example, It is important to note that the badge feature is not only designed to be used in conjunction with a hair brush that features a removable pad. The inventor has intended the use of the badge to be more versatile and applicable to any brush design that features a removable pad or any other type of brush. This means that the badge can be used in a variety of brush designs, not just those that have a removable pad. This is an intentional design feature as it expands the potential applications and usage of the badge. It also allows for greater flexibility in its usage, making it a more versatile and practical solution. Additionally, this design feature allows for the badge to be used in other brush designs that may have different features or functionalities, making it a more universal solution.

This means that the invention can be applied in various ways and can be modified structurally and logically. Any feature described in relation to a specific embodiment or drawing can be used in other embodiments or drawings unless stated otherwise. Additionally, the claims should be interpreted to include any equivalent or similar solutions that fall within the scope of the invention.

Furthermore, the claims should be read in light of the specification as a whole and not just in isolation, and this includes the drawings. The drawings are considered a part of the specification and are used to illustrate the invention, and should be understood in the context of the entire specification and not in isolation.

Accordingly, the invention is not limited by the disclosure, but instead its scope is to be determined entirely by the following claims.

The invention claimed is:

1. A hair brush comprising:

a handle, a head, cojoined to the handle; the head comprising:

a removable and replaceable, flexible, bristle pad; and a recessed bed of a sufficient size and shape to accommodate the bristle pad;

wherein the bristle pad has a first thickness, an outermost edge, and pad finger depressions on opposite sides of the bristle pad; the pad finger depressions are areas that extend into the bristle pad from the outermost edge and the pad finger depressions have a second thickness that is less than the first thickness;

wherein the pad finger depressions are configured to assist a user in removing and replacing the bristle pad within the recessed bed by deforming the bristle pad and removing and replacing it in a direction perpendicular to the surface of the bristle pad.

2. The hair brush in accordance with claim 1; said bristle pad comprising an array of bristles disposed thereon.

3. The hair brush in accordance with claim 1; the hair brush further comprising a badge and a snap-in mating holder for the badge.

4. The hair brush in accordance with claim 1; wherein the head further includes head finger depressions; wherein the pad finger depressions align with the head finger depressions, when the pad is in situ within the recessed bed.

5. The hair brush in accordance with claim 1; wherein the further includes an outer rim on each of its opposing sides of the recessed bed to hold the bristle pad securely in place once the bristle pad is installed into the recessed bed.

6. The hair brush in accordance with claim 3; wherein the badge comprises a plurality of interchangeable badges that are configured to be selectively installed in the brush to help users to identify their brush.

7. The hair brush in accordance with claim 6 wherein the plurality of interchangeable badges can be different colors and/or shapes.

8. The hair brush in accordance with claim 3; wherein the snap-in mating holder is located on the brush handle.

* * * * *